US007155998B1

(12) United States Patent
Shyu

(10) Patent No.: US 7,155,998 B1
(45) Date of Patent: Jan. 2, 2007

(54) T-SHAPED RATCHET WRENCH

(76) Inventor: Wen-Tsai Shyu, 8F, No. 68, Yu-Shyan Rd., Taiping (TW) 411

( * ) Notice: Subject to any disclaimer, the term of this patent is extended or adjusted under 35 U.S.C. 154(b) by 0 days.

(21) Appl. No.: 11/176,905

(22) Filed: Jul. 8, 2005

(51) Int. Cl.
*B25B 13/46* (2006.01)
*B25G 1/04* (2006.01)
*B25G 3/12* (2006.01)

(52) U.S. Cl. ..... 81/60; 81/177.2

(58) Field of Classification Search ..... 81/60, 81/177.2, 177.85
See application file for complete search history.

(56) References Cited

U.S. PATENT DOCUMENTS 5,797,300 A * 8/1998 Fairbanks ..... 81/60
5,943,924 A * 8/1999 Jarvis ..... 81/177.2
6,240,809 B1 * 6/2001 Sasarak ..... 81/60
6,263,766 B1 * 7/2001 Jarvis ..... 81/60
6,286,395 B1 * 9/2001 Frazier ..... 81/60
6,336,382 B1 * 1/2002 Cerda ..... 81/60
6,408,721 B1 * 6/2002 Lee ..... 81/60
6,938,521 B1 * 9/2005 Skeens ..... 81/60
2001/0020403 A1 * 9/2001 Jarrett ..... 81/60
2002/0088311 A1 * 7/2002 Cerda ..... 81/60
2003/0188605 A1 * 10/2003 Chang ..... 81/60

* cited by examiner

*Primary Examiner*—David B. Thomas
(74) *Attorney, Agent, or Firm*—Troxell Law Office, PLLC

(57) ABSTRACT

A T-shaped ratchet wrench having a main body and a force-applying auxiliary arm. The main body includes a cross shaft and a working shaft. A ratchet driving mechanism having a change-over selector is disposed within an intersection position of both shafts. Each end of the cross shaft having an annular groove, and the working shaft has a polygonal head for inserting into a sleeve. Furthermore, the working shaft includes an annular groove in close vicinity to the cross shaft. The force-applying auxiliary arm includes an internal hole for mounting on either end of the working shaft or the cross shaft of the main body. The force-applying auxiliary arm has one end with an engaging socket and another end with a handle portion.

4 Claims, 4 Drawing Sheets

T-SHAPED RATCHET WRENCH

BACKGROUND OF THE INVENTION

1. Fields of the Invention

The invention relates to a T-shaped ratchet wrench, and more particularly, to a T-shaped ratchet wrench having a force-applying auxiliary arm that can be used as a protection sleeve on a working shaft. In other words, the force-applying auxiliary arm can serve as protection of the working shaft from external impacts when the T-shaped ratchet wrench is not used. Meanwhile, it can be used to extend the moment arm for operating the T-shaped ratchet wrench with less force.

2. Description of the Related Art

U.S. Pat. Nos. 5,797,300 and 6,898,998 teach a T-shaped ratchet wrench with a working shaft that is not properly protected. So, the working shaft thereof is easily bent and cracked due to exposure to an unexpected impact. This will result in difficulties in force-application, or even in malfunction, thereby causing much trouble to the operators.

SUMMARY OF THE INVENTION

A primary object of the invention is to eliminate the above-mentioned drawbacks and to provide a T-shaped ratchet wrench having a force-applying auxiliary arm that serves as protection sleeve on the working shaft when the T-shaped ratchet wrench is not used. Meanwhile, it is very practical for operating the T-shaped ratchet wrench. Accordingly, the service life of the T-shaped ratchet wrench can be effectively extended by providing proper protection to the working shaft.

The T-shaped ratchet wrench primarily includes a main body and a force-applying auxiliary arm. The invention features an annular groove that is provided in a cross shaft and a working shaft of the main body for retaining the force-applying auxiliary arm in place.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 2:
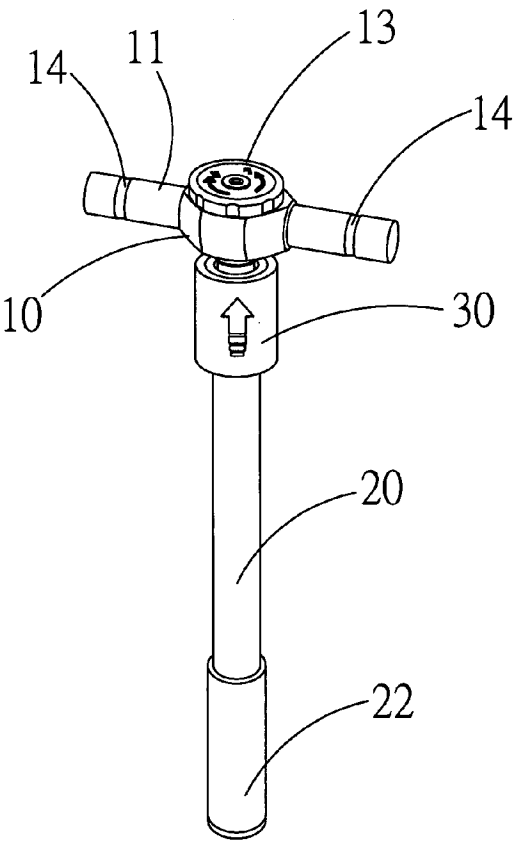
FIG. 2 is a perspective view of the T-shaped ratchet wrench in accordance with the invention after assembly.
Figure 1:
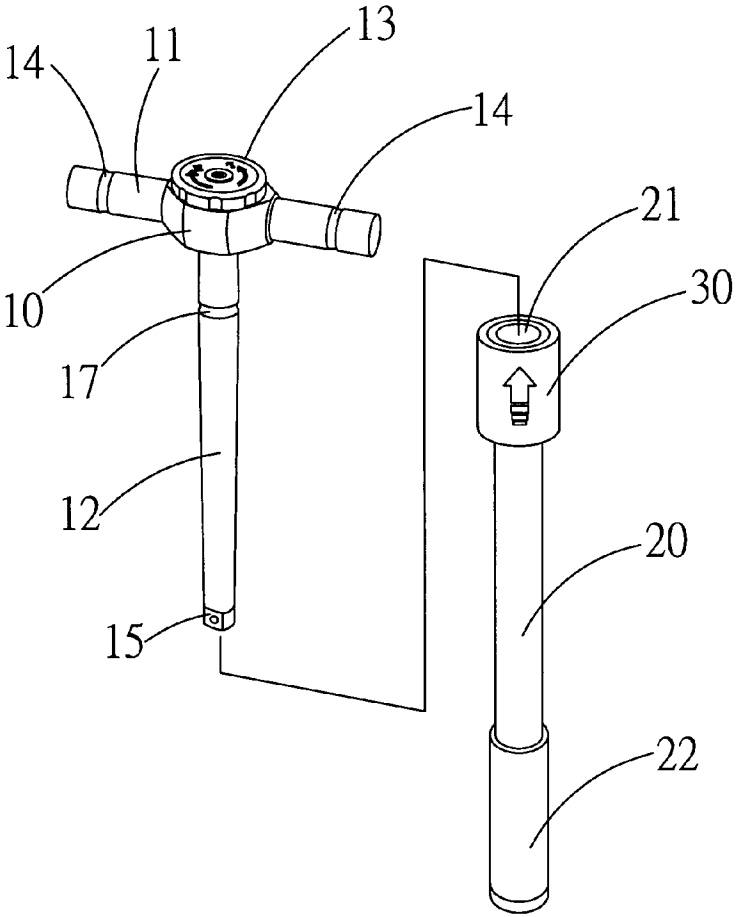
FIG. 1 is a perspective view of a main body and a force-applying auxiliary arm of the invention in a detached position.
Figure 3:
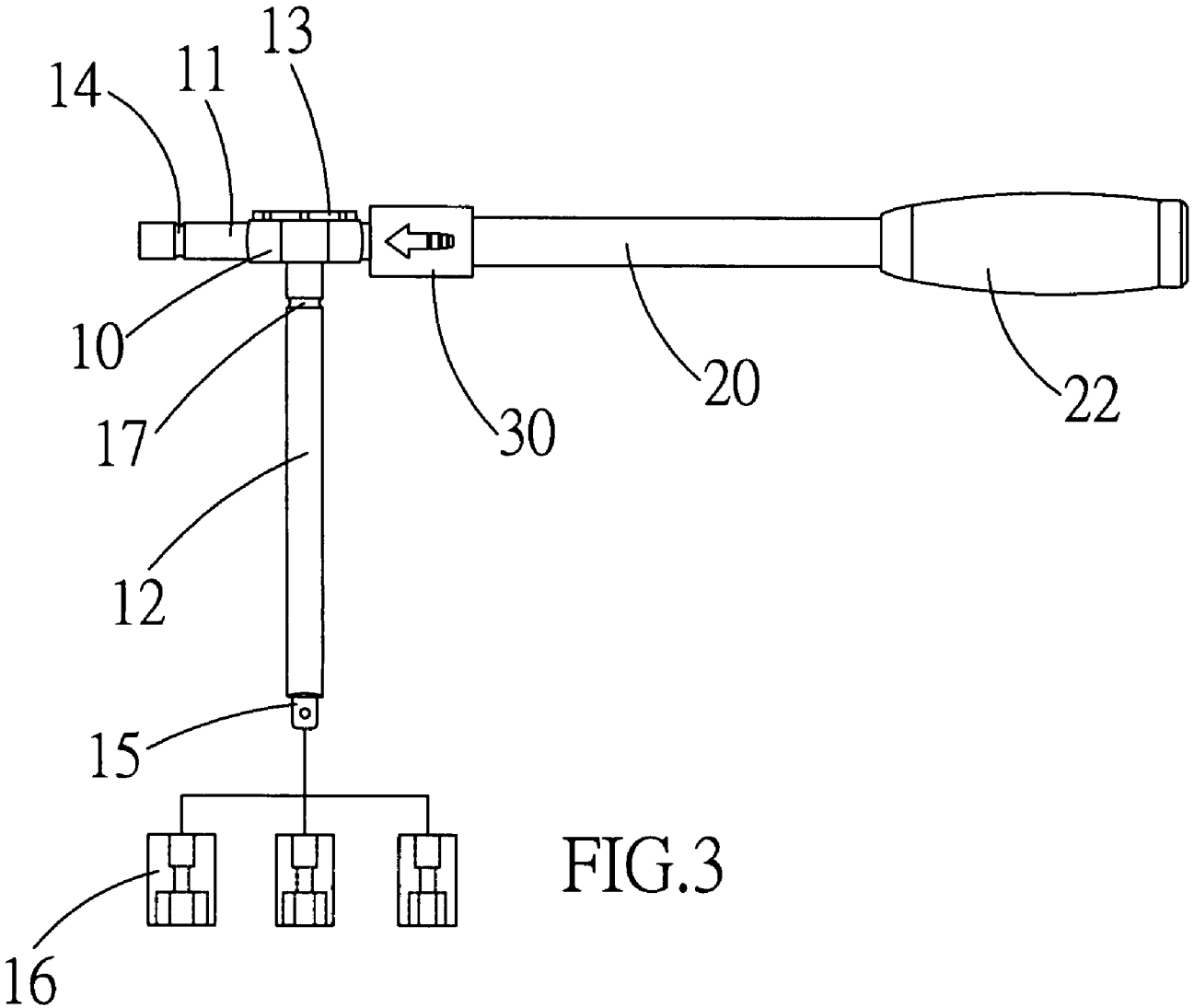
FIG. 3 is a schematic drawing of the T-shaped ratchet wrench in accordance with the invention while the force-applying auxiliary arm is mounted on a cross shaft for extending the moment arm.

Referring to FIGS. 1 through 3, a preferred embodiment of the invention includes:

a main body 10 having a cross shaft 11 and a working shaft 12, a ratchet driving mechanism (not shown) with a change-over selector 13 being disposed within an intersection position of both shafts 11, 12, each end of the cross shaft 11 having an annular groove 14, the working shaft 12 having a polygonal head 15 for inserting into a sleeve 16, the working shaft 12 having an annular groove 17 in close vicinity to the cross shaft 11; and a force-applying auxiliary arm 20 having an internal hole 21 for mounting on either end of the working shaft 12 or the cross shaft 11 of the main body 10, the force-applying auxiliary arm 20 having one end with an engaging socket 30 and another end with a handle portion 22.

The force-applying auxiliary arm 20 can serve as protection sleeve on the working shaft 12 when the T-shaped ratchet wrench is not used. Meanwhile, it is very practical for operating the T-shaped ratchet wrench.

Figure 4:
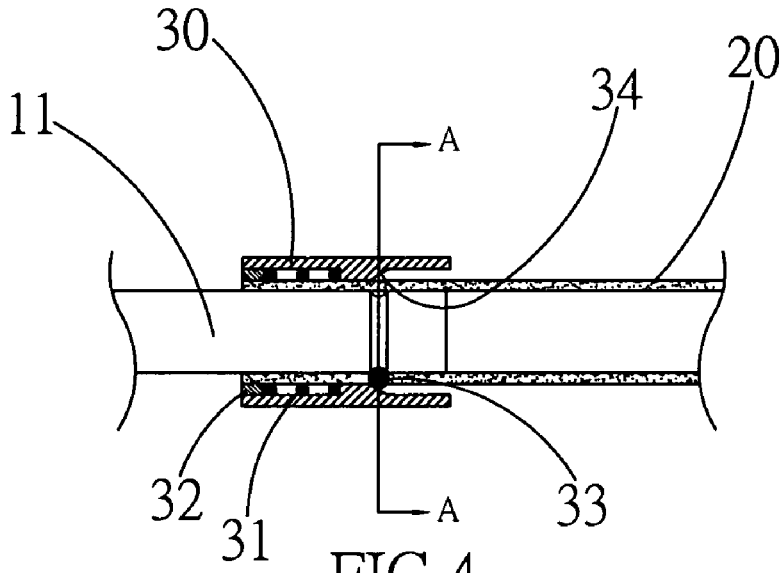
FIG. 4 is an axially cutaway view of an engaging socket in an engaged position.
Figure 5:
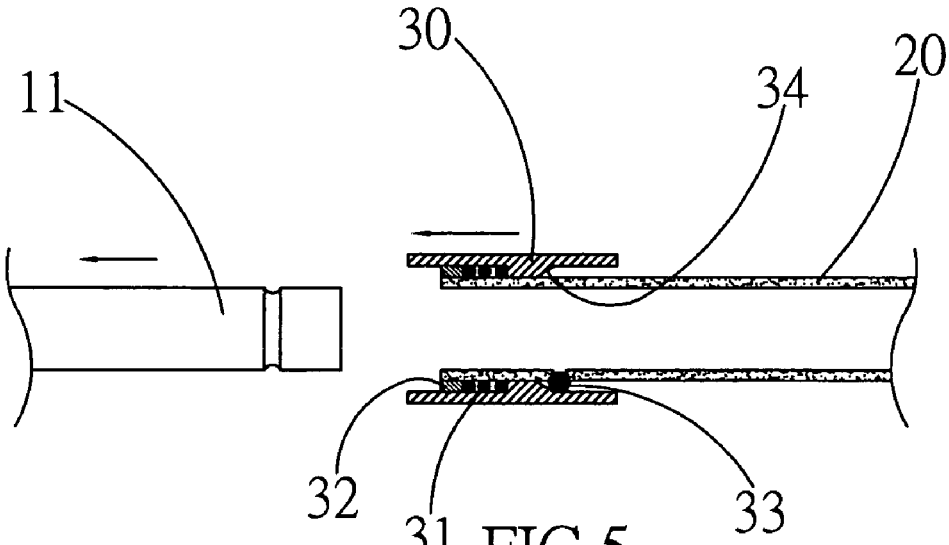
FIG. 5 is an axially cutaway view of the engaging socket in an disengaged position.
Figure 6:
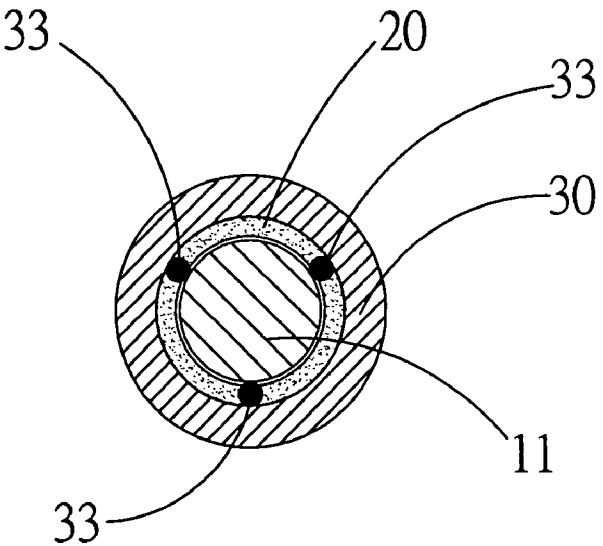
FIG. 6 is an cross-sectional view taken along the line A—A in FIG. 4.

As shown in FIGS. 4 through 6, the engaging socket 30 on the force-applying auxiliary arm 20 includes a resilient element 31, a locating element 32 and a plurality of engaging balls 33. Moreover, the inner wall of the engaging socket 30 is provided with a supporting portion 34. The supporting portion 34 is movable in a position for engaging or disengaging the engaging balls 33. In this way, the force-applying auxiliary arm 20 can be easily retained or released.

Figure 7:
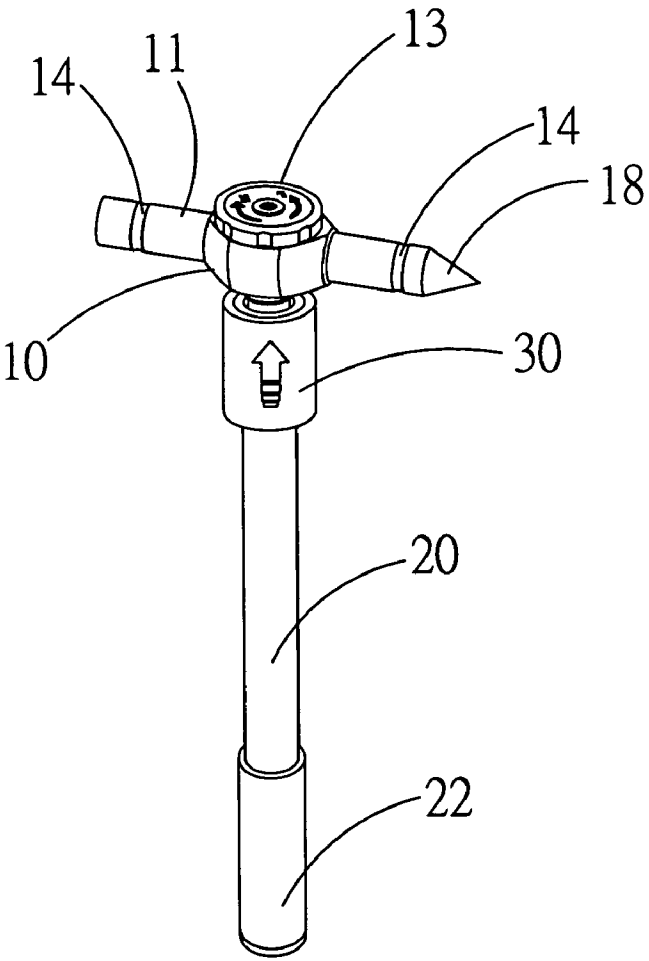
FIG. 7 is a perspective view of another embodiment of the invention.

As shown in FIG. 7, a pointed cone portion 18 is formed at one end of the cross shaft 11 of the main body 10 for enhancing the functionality of the invention. In case of emergency, the pointed cone portion 18 can be used as life-saving means to knock against the toughened glass (not shown).

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A T-shaped ratchet wrench comprising:

a) a main body having:

I) a cross shaft;

ii) a working shaft having a first end connected to a middle portion of the cross shaft and a polygonal head located on a second end thereof;

iii) a ratchet driving mechanism having a change-over selector located at an intersection of the cross shaft and the working shaft; and iv) three annular grooves including a first groove located on a first of two opposing ends of the cross shaft, a second groove located on a second end of the two opposing ends of the cross shaft, and a third groove located on the working shaft; and b) a force-applying auxiliary arm having:

I) an internal hole, a selected shaft end selected from a group consisting of the second end of the working shaft and one of the two opposing ends of the cross shaft is selectively inserted into the internal hole;

ii) an engaging socket located of on a first auxiliary arm end of the force-applying auxiliary arm and selectively locking the force-applying auxiliary arm in one of the three annular grooves of the selected shaft end; and iii) a handle portion located on a second auxiliary arm end of the force-applying auxiliary arm.

2. The T-shaped ratchet wrench according to claim 1, wherein the engaging socket having:

a) a resilient element;

b) a locating element;

c) a plurality of engaging balls movable between engaging and disengaging positions; and d) a supporting portion located on an inner wall thereof and movable between first and second positions, wherein, when the supporting portion is located in the first position, the plurality of engaging balls are located in the engaging position and selectively being inserted into one of the three annular grooves; and, when the supporting portion is located in the second position, the plurality of engaging balls are located in the disengaging position.

3. The T-shaped ratchet wrench according to claim 1, further comprising a pointed cone portion located on one of the two opposing ends of the cross shaft.

4. The T-shaped ratchet wrench according to claim 1, wherein the third groove is located on the working shaft at a position closer to the intersection of the cross shaft and the working shaft than the polygonal head.

* * * * *